US006431256B1

(12) United States Patent
Ferretti et al.

(10) Patent No.: US 6,431,256 B1
(45) Date of Patent: Aug. 13, 2002

(54) SURFACE OF A COOLING ROLL FOR CONTINUOUS CASTING MACHINES

(75) Inventors: Alessandro Ferretti; Pietro Tolve; Romeo Capotosti, all of Rome (IT); Gerald Hohenbichler, Linz (AT)

(73) Assignees: Acciai Speciali Terni S.P.A., Terni (IT); Voest-Alpine Industrieanlagenbau, Linz (AT)

( * ) Notice: Subject to any disclaimer, the term of this patent is extended or adjusted under 35 U.S.C. 154(b) by 0 days.

(21) Appl. No.: 09/554,248

(22) PCT Filed: Nov. 12, 1998

(86) PCT No.: PCT/IT98/00319

§ 371 (c)(1),
(2), (4) Date: Jul. 19, 2000

(87) PCT Pub. No.: WO99/24193

PCT Pub. Date: May 20, 1999

(30) Foreign Application Priority Data

Nov. 12, 1997 (IT) ..... RM97A0694

(51) Int. Cl.[7] ..... B22D 11/06
(52) U.S. Cl. ..... 164/428; 164/433

(58) Field of Search ..... 164/480, 433, 164/482, 428

(56) References Cited

U.S. PATENT DOCUMENTS 4,027,716 A 6/1977 Theobald et al.
5,701,948 A * 12/1997 Strezov et al. ..... 164/480

FOREIGN PATENT DOCUMENTS

EP 0 309 247 * 3/1989
EP 0 463 177 * 1/1990

* cited by examiner

*Primary Examiner*—M. Alexandra Elve
*Assistant Examiner*—Len Tran
(74) *Attorney, Agent, or Firm*—Browdy and Neimark

(57) ABSTRACT

A cooling roll having superficial dimples, for continuous casting machines with a pair of counterotating rolls in contact with the cast metal is characterized by the fact that it presents the surface that comes to contact with the cast metal provided with a first and a second dimensional order of cavities (6,7) randomly spaced, and optionally, at least partially in contact between them; the strickle impressed on the roll surface (1) of each cavity (6,7) of at least one of said first and second dimensional order being of polygonal or circular shape and, more preferably rhomboidal.

15 Claims, 4 Drawing Sheets

SURFACE OF A COOLING ROLL FOR CONTINUOUS CASTING MACHINES

CROSS REFERENCE TO RELATED APPLICATION

Figure 1:
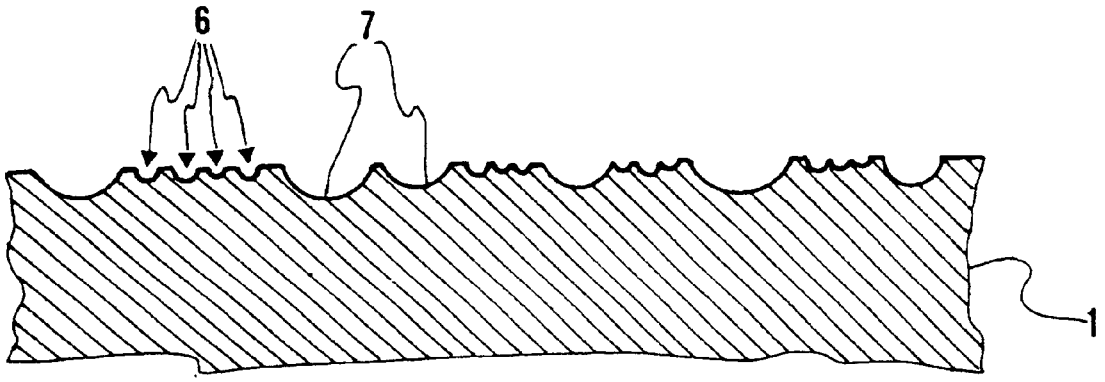

The present application is the national stage under 35 U.S.C. 371 of PCT/IT98/00319, filed Nov. 12, 1998.

The present invention relates to an ingot mould roll for continuous casting machines and, more specifically, to the superficial conformation of the counterotating rolls of the ingot mold for the metal strip production.

Usually, strips are obtained by a conventional process that provides for the continuous casting of the flat bloom, followed by an eventual beveling, flat bloom heating and hot-rolling.

This process requires a great energy consumption for the flat blooms heating and for processing of the material. On the other hand, the continuous casting process of strips is a technique that enables to produce slim strips, directly as a cast product, thus eliminating the beveling and hot-rolling processes and maintaining the cold-rolling for the slimmer thicknesses only.

Therefore, in the case of a continuous casting of the strips the conditioning of their surfaces is clearly impossible, and it is therefore absolutely necessary that the strip be produced with the all but total absence of surface flaws. To obtain this result the solidification of the strip close to the ingot mold roll has to be piloted.

To solve this problem different solutions are available in art. One solution is based on the embodiment of predetermined gaps on the ingot mold surface. For instance, in the european patent application EP O 493 290 A1, a mobile wall for the metal solidification is described wherein a suitable wrinkledness is embodied on a copper chaplet, and whose cavities thereof are filled with a lower conductivity metal. Thus, a surface is created wherein an alternance is present between higher and lower thermal exchange zones.

Moreover, in the european patent EP O 309 247 B1 that result is obtained by making a series of cavities, of circular or oval shape, and with a regular disposition on the surface of each ingot mold roll.

In both cases a strip is produced with a wrinkled surface thereof. In the applications wherein the surface aspect is determinant this fact causes problems, as even the subsequent processes may be inadequate to restore the original wrinkledness. Moreover, the aforementioned solutions do not solve the problem on those roll surface zones that are left unaffected by the process, and therefore wherein very intense thermal exchanges occur.

Finally, in the first case the necessity of filling the cavities with a second metal and, in the second case, the necessity of emboding regularly spaced cavities on the roll surface, entails a great complexity and therefore a high cost of the embodiment and of the subsequent ingot mold maintainance.

Therefore, the present invention aims at solving the aforementioned drawbacks and at providing an ingot mold wherein the heat extraction and the metal solidification are functions of the ingot mold design, rather than of the inherent features of the material.

Therefore, the invention provides a cooling roll having surface dimples, for continuous casting machines with a pair of counterotating rolls in contact with the molten metal, characterized in that the surface dimples thereof consist in a multiplicity of cavities of a first and a second dimensional order, unevenly spaced on its surface, and optionally, being at least partially in contact among them.

According to the invention, the first order of cavities serves to the purpose of reducing the thermal flow between the solidifying metal and the roll. The depth of these cavities may vary between 2 and 10 $\mu$m, and their equivalent diameter is comprised between 10 and 50 $\mu$m.

Always according to the invention, the second order of cavities serves to the purpose of creating local gaps. Thus, the solidification is piloted by making it discrete rather than continuous, thereby breaking up and reducing the stresss caused by the shrinking that cause the strip flawing. By virtue of the presence of the first order of cavities that performs a first reduction of the thermal flux, this second order is constituted of cavities of different shapes and of dimensions contained in an equivalent diameter comprised between 0.2 and 1 mm, while the depth of each cavity thereof is comprised between 40 and 200 $\mu$m, with a consequent advantage for the surface aspect of the strip.

The fact that the cavities are randomly spaced on the roll's surface helps in the breaking and reducing of stresses due to the shrinkage, avoiding any preferential direction in which single stresses can combine locally, rising higher values able to cause micro-macro defects.

Moreover, the distance between each of the first order cavities is comprised from 0 to 60 $\mu$m, while the distance between each of the second order cavities is comprised from 0 to 1.5 mm.

Furthermore, the pattern impressed on the roll surface of each cavity of at least one of said first and second orders of cavities has a shape selected from the group comprising the polygonal and the circular shape and, more preferably, rhomboidal.

According to the invention, the surface of each roll that comes in contact with the cast metal is constituted of a material having a thermal conductivity comprised between 15 and 380 W/m·K. and is embodied in a material selected from the following group: steel, copper, nickel and chrome, and/or their alloys, selected in order to provide the constancy of cavities for the entire rolls life.

Advantageously, according to the present invention, with an appropriate webbing of the ingot mold surface, the system is capable of producing flawless strips possessing a controlled roughness such that it can be restored in the subsequent processes.

Specifically, according to the present invention, the webbing is obtained with a peening process of the surface of the rolls, in order to produce cavities on the same roll surface.

Advantageously, according to the present invention, cavities are closely distributed, randomly spaced, of shape that may vary according to the kind of shots employed and anyhow characterized in that it comprises the presence of two different orders of cavity. Thus, the solidification is piloted by making it happen in a discrete rather than continuous way, thereby breaking up and reducing the stresses due to the shrinking that cause the strip flawing.

Figure 2A:
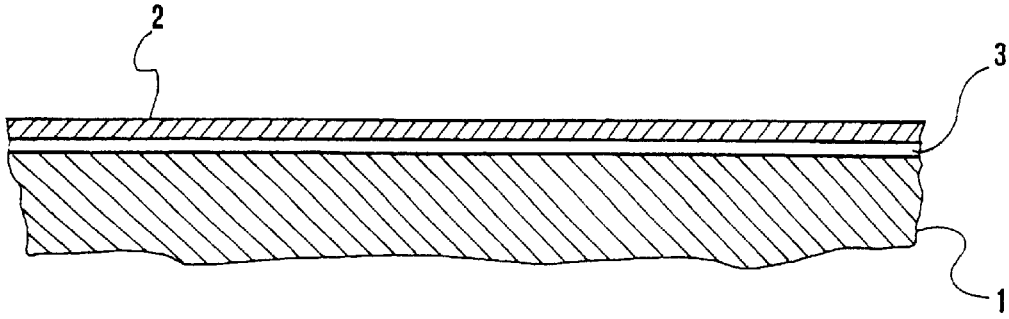
Figure 3A:
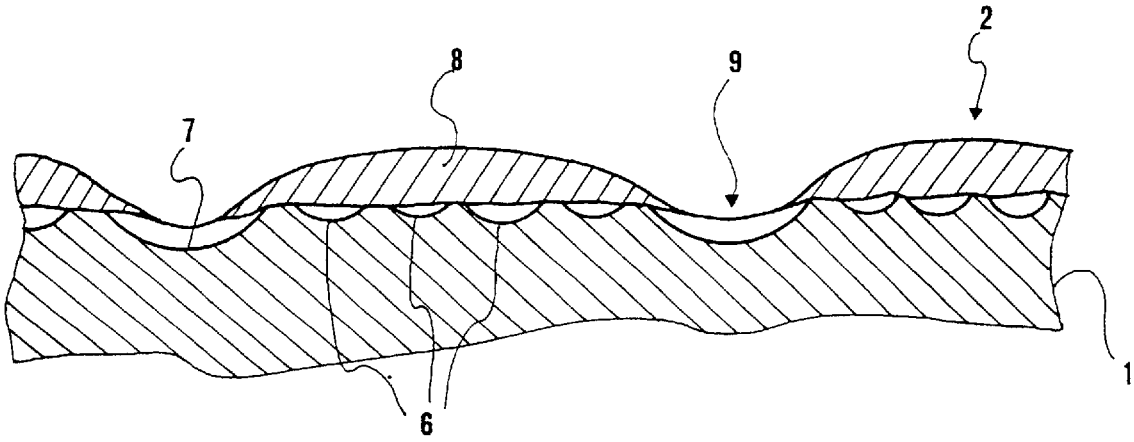
Figure 3B:
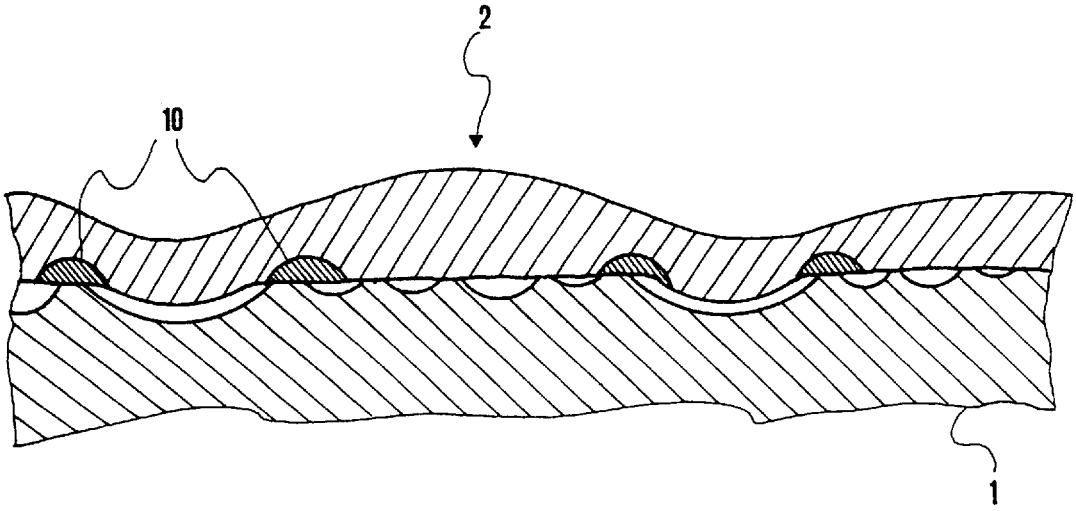
Figure 4:
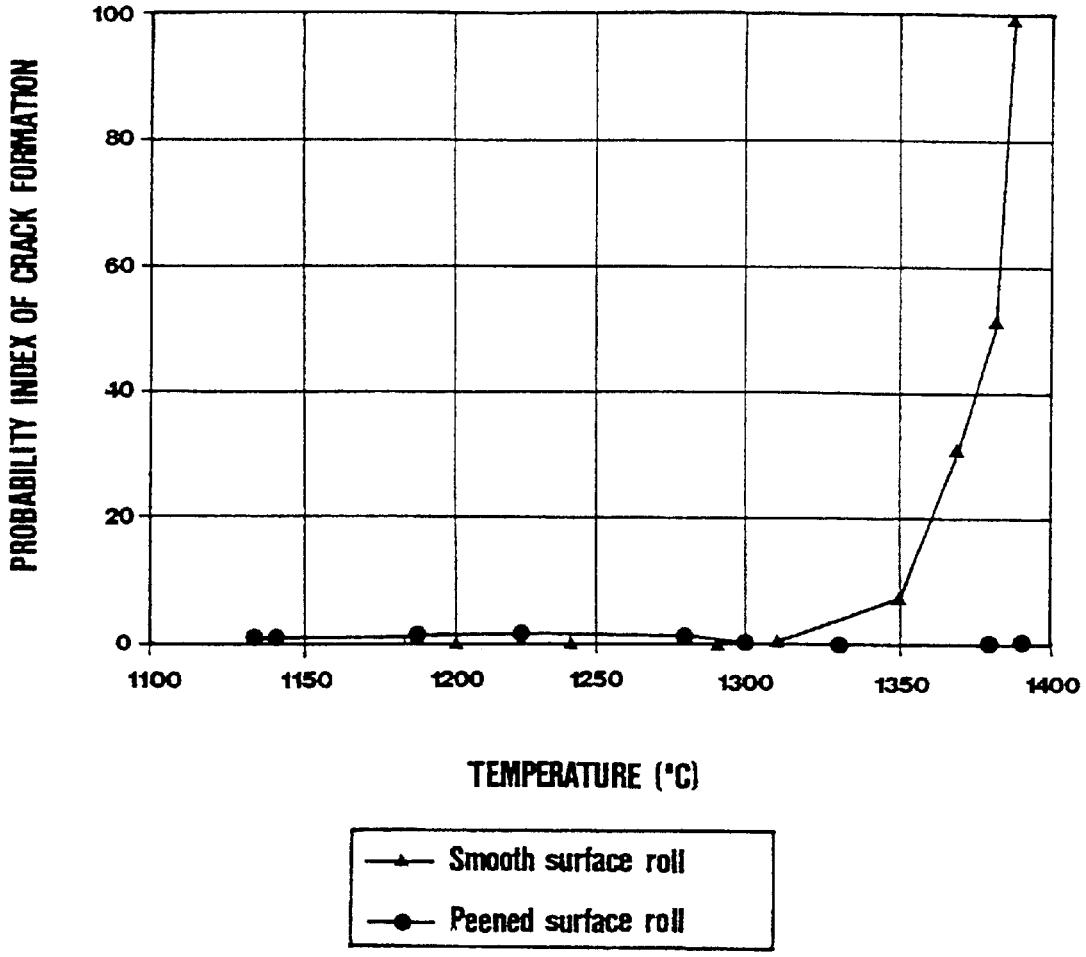

An illustrative and comparative example will be disclosed hereinafter, given by way of explanation and not for limitative purposes, of the behaviour of a metal, initially liquid, when it is cooled in an ingot mold according to an embodiment of the present invention and according to an ingot mold of the state of the art, with reference to the annexed drawings wherein:

FIG. 1 is a schematic sectional view showing the surface of a roll modified according to the present invention;

FIGS. 2*a,* 2*b* and 2*c* are schematic views showing the behaviour of a cast metal when it is solidified on a smooth surface;

FIGS. 3*a* and 3*b* are schematic views representing the behaviour of a cast metal when it is solidified on a surface according to the present invention; and FIG. 4 is a diagram reporting the values of the probability index of crack formation on steel strips depending on the strip temperature and on the smooth surface typology of a roll and for a surface modified according to the present invention.

EXAMPLE

In this example the cast metal is austenitic inox steel AISI 304 as metal to be solidified with the shape of a strip with a 3 mm thickness. The sequence shown in FIGS. 2*a,* 2*b* and 2*c* reports the behaviour of that material when it is solidified on a smooth cooled copper chaplet.

With reference to FIG. 2*a,* in it the surface of a roll 1 as an element of an ingot mold is schematically represented. The surface is smooth and is in contact with a cast metal. It can be evidenced how the steel begins to solidify at the meniscus 3 of the ingot mold, forming a thin layer 2 of an all but uniform thickness of the order of 70–100 $\mu$m.

Figure 2B:
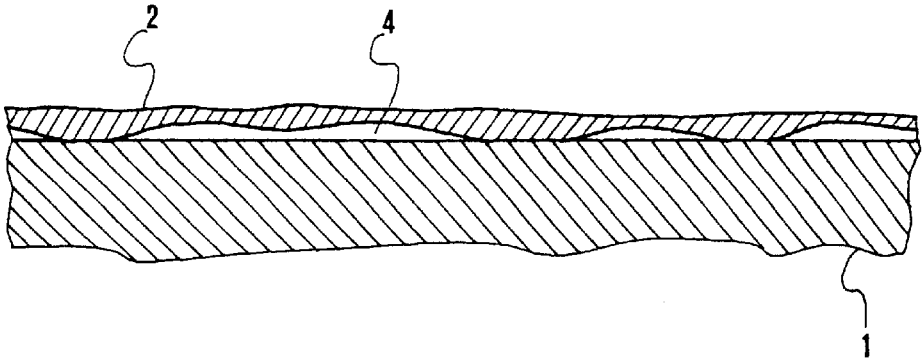

Then, according to FIG. 2*b,* the thin layer 2 detaches itself off the roll, and as it is a very thin and not very resistant structure, it is subject to great instability, therefore creating random waving with a variable pitch of around 30–80 mm. In this condition, the existence of waves causes the formation of an air space 4 of variable thickness between strip and roll, with maximum detachment values of the order of 20 $\mu$m. As a consequence, heat extraction from the strip becomes remarkably uneven and temperature differences of over 120° C. are generated on the strip surface, as the strip zones more detached from the roll remain very hot.

Figure 2C:
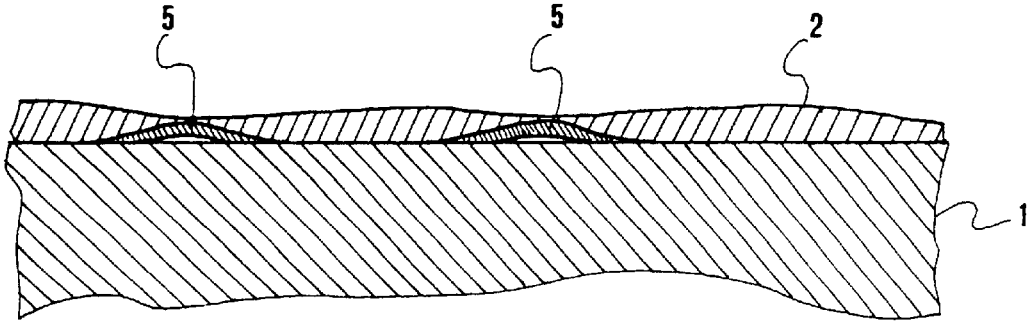

Then, as it can be noted in FIG. 2*c,* the solidified thickness 2 increases in an uneven way, with the forming of relevant thinnings 5 correspondingly to the zones that are more detached from the roll. When the ferrostatic pressure reaches a predetermined value equal to about 10 cm of depth off the meniscus, the same pressure brings again the strip in contact with the roll and the wavings gradually disappear. Nevertheless, even if temperature differences lessen, they persist until the exiting of the strip from under the rolls. However, correspondingly to zones 5 that present the most significant thinnings of the thickness, high values of tensile stress are generated, where the surface temperature is of the order of 1370–1390° C. and the AISI 304 steel ductility is very low, thereby leading to the forming of cracks.

With reference now to FIG. 1 and to FIGS. 3*a* and 3*b,* in them and in a schematic way the surface of a generic roll 1 is shown modified according to the present invention. Specifically, the thermal exchange mechanism changes drastically when in presence of a surface modified according to the present invention.

According to FIG. 3*a,* the intense initial thermal exchange is significantly curbed by the presence of a multiplicity of small cavities 6, and, moreover, as the steel 2 does not seep completely into a second multiplicity 7 of larger cavities , there is a slight delay in the solidification of the same correspondingly to the latter.

In the first instants of the solidification, near the meniscus 2 there is no forming of a thin layer of an all but uniform thickness (as is the case with the smooth surface roll), but instead the forming of completely solidified zones 8 interconnected by zones 9 still in a pasty state.

In this condition therefore, the detaching of the thin layer off the roll with the ensuing forming of waves does not take place. Thus, the strip surface reaches the complete solidification at an approximate depth of 10 cm off the meniscus when the ferrostatic pressure succeeds in keeping the strip adherent to the roll.

According to FIG. 3*b,* only from this moment onwards states of tensile stress are triggered in the strip, reaching the maximum values thereof on the surface of the colder zones near to the cavities 6 and 7. As it can be noted from the figure, there are zones 10 wherein stress states have an intensity that is much lower than those occurring on a strip cast with smooth surface rolls.

With reference now to FIG. 4, in it a diagram is shown, reporting the values of the probability index of crack forming on steel AISI 304 strips, depending on the latter temperature, and on the typology of a smooth roll surface and for a surface modified according to the present invention.

As it can be noted, the crackability index is significantly better for a roll with a surface peened according to the present invention, in an interval comprised between 1370 and 1390° C., i.e. in the low ductility zone of the AISI 304 steel, in which the forming of cracks mainly occurs.

The present invention is not limited to the embodiment example described above, but comprises any embodiment variant whatsoever. To men skilled in the art further aims and advantages will be evident that the present invention possesses in other embodiment forms comprised in the scope of the appended claims.

What is claimed is:

1. A cooling roller of a continuous casting machine, said cooling roller comprising a rotatable roller surface adapted to contact a continuously cast hot metal strip for the cooling of the metal strip, said roller surface being provided with unevenly spaced surface dimples, said surface dimples comprising a first group of cavities having a depth between 2 and 10 $\mu$m and a diameter between 10 and 50 $\mu$m, and a second group of cavities having a depth of between 40 and 200 $\mu$m and a diameter between 0.2 and 1 mm.

2. The cooling roller of claim 1 wherein said cavities of said first group of cavities are at least partially spaced apart from one another by a first distance, said first distance being up to 60 $\mu$m, and wherein said cavities of said second group of cavities are at least partially spaced apart from one another by a second distance, said second distance being up to 1.5 mm.

3. The cooling roller of claim 2 wherein some of said cavities are in contact with others of said cavities.

4. The cooling roller of claim 1 wherein some of said cavities are in contact with others of said cavities.

5. The cooling roller of claim 4 wherein the surface in contact with the cast metal is constituted of a material having a thermal conductivity between 15 and 380 W/m·K.

6. The cooling roller of claim 3 wherein the surface in contact with the cast metal is constituted of a material having a thermal conductivity between 15 and 380 W/m·K.

7. A continuous casting machine having two counterrotating rollers as claimed in claim 2.

8. A continuous casting machine having two counterrotating rollers as claimed in claim 3.

9. A continuous casting machine having two counterrotating rollers as claimed in claim 4.

10. A continuous casting machine having two counterrotating rollers as claimed in claim 5.

11. The surface of a cooling roll (1) for continuous casting machines according to claim 1, wherein the pattern of each cavity (6, 7) impressed on the surface of the roll (1) of at least one of said first and second dimensional order has a shape selected from the group consisting of a polygonal and a circular shape.

12. The surface of a cooling roll (1) for continuous casting machines according to claim 11, wherein said polygonal shape of said cavity is substantially rhomboidal.

13. The surface of a cooling roll (1) for Continuous casting machines according to claim 1, wherein the surface in contact with the cast metal is constituted of a material having a thermal conductivity comprised between 15 and 380 W/m·K.

14. The surface of a cooling roll (1) for continuous casting machines according to claim 1, wherein said surface destined to come in contact with the cast metal is embodied in a material selected from the group consisting of:

steel copper nickel chrome and their alloys.

15. Continuous casting machines having two counterotating rolls as claimed in claim 1.

* * * * *